US009556685B2

(12) United States Patent
Blanchard et al.

(10) Patent No.: US 9,556,685 B2
(45) Date of Patent: Jan. 31, 2017

(54) INSIDE RISER TREE CONTROLS ADAPTER AND METHOD OF USE

(71) Applicant: Oceaneering International, Inc., Houston, TX (US)

(72) Inventors: Chad Blanchard, Magnolia, TX (US); Daniel Vela, Tomball, TX (US); Stephen Pfiester, Cypress, TX (US); Nicole Marino, Houston, TX (US)

(73) Assignee: Oceaneering International, Inc., Houston, TX (US)

( * ) Notice: Subject to any disclaimer, the term of this patent is extended or adjusted under 35 U.S.C. 154(b) by 0 days.

(21) Appl. No.: 14/685,771

(22) Filed: Apr. 14, 2015

(65) Prior Publication Data

US 2016/0305193 A1 Oct. 20, 2016

(51) Int. Cl.
*E21B 17/01* (2006.01)
*E21B 34/04* (2006.01)

(52) U.S. Cl.
CPC ..... *E21B 17/01* (2013.01); *E21B 34/045* (2013.01)

(58) Field of Classification Search
CPC ..... E21B 17/01; E21B 34/045
USPC ..... 166/360
See application file for complete search history.

(56) References Cited

U.S. PATENT DOCUMENTS

| | | | | |
|---|---|---|---|---|
| 6,102,124 | A * | 8/2000 | Skeels | E21B 33/0355 166/347 |
| 7,121,346 | B2 * | 10/2006 | Wolff | E21B 33/035 166/348 |
| 7,318,480 | B2 * | 1/2008 | Hosie | E21B 33/035 166/255.2 |
| 7,513,308 | B2 * | 4/2009 | Hosie | E21B 33/035 166/255.2 |
| 8,336,629 | B2 * | 12/2012 | Vaynshteyn | E21B 33/0355 166/344 |
| 8,443,899 | B2 * | 5/2013 | June | E21B 33/035 166/368 |
| 8,511,389 | B2 * | 8/2013 | Fenton | E21B 33/0385 166/250.01 |
| 8,800,662 | B2 * | 8/2014 | Miller | E21B 33/0355 166/250.01 |
| 9,273,531 | B2 * | 3/2016 | Tan | E21B 33/0422 |
| 2005/0241821 | A1 * | 11/2005 | Milberger | E21B 33/038 166/100 |
| 2008/0110633 | A1 * | 5/2008 | Trewhella | E21B 33/04 166/336 |
| 2008/0202761 | A1 * | 8/2008 | Trewhella | E21B 33/04 166/351 |
| 2015/0240585 | A1 * | 8/2015 | Mancuso | E21B 33/0355 166/338 |

* cited by examiner

*Primary Examiner* — Matthew R Buck
(74) *Attorney, Agent, or Firm* — Maze IP Law, PC

(57) ABSTRACT

A riser tree controls adapter comprises an outer riser tree controls adapter, placed outside a first tubular, and an inner riser tree controls adapter placed outside a second tubular and configured to be received into the outer riser tree controls adapter. Once inserted into the outer riser tree controls adapter, one or more control signal pathways are provided between a junction plate control connection receiver and a corresponding set of inner connection interfaces.

20 Claims, 11 Drawing Sheets

INSIDE RISER TREE CONTROLS ADAPTER AND METHOD OF USE

BACKGROUND

Tubing hangers for subsea trees are deployed inside a marine riser and require hydraulic and/or electrical controls. In some cases, a subsea test tree or subsea safe tree is utilized above a tubing hanger running tool and also requires hydraulic and/or electrical controls. These controls are supplied through an umbilical that is clamped to the drill pipe during deployment every two to three joints. Deploying the umbilical and clamping it to the drill pipe while the rig is deploying a subsea device such as a tubing hanger and/or subsea test tree is time consuming due to the speed of the reel, clamping efforts, and mitigating the risks of damaging the controls umbilical.

FIGURES

Various figures are included herein which illustrate aspects of embodiments of the disclosed inventions.

DESCRIPTION OF EXEMPLARY EMBODIMENTS

Figure 1:
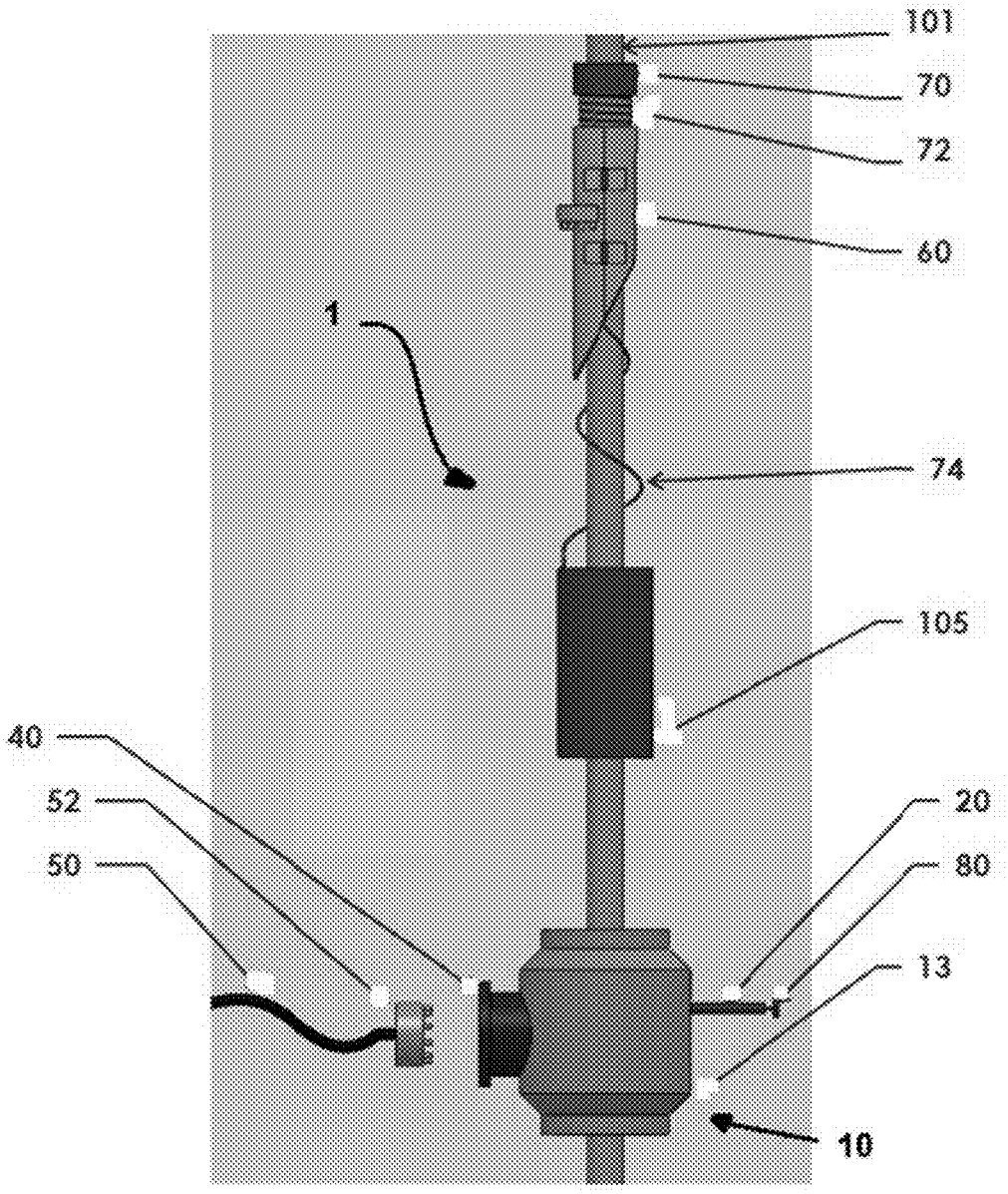
FIG. 1 is a plan view in partial perspective of an exemplary riser tree controls adapter.
Figure 11:
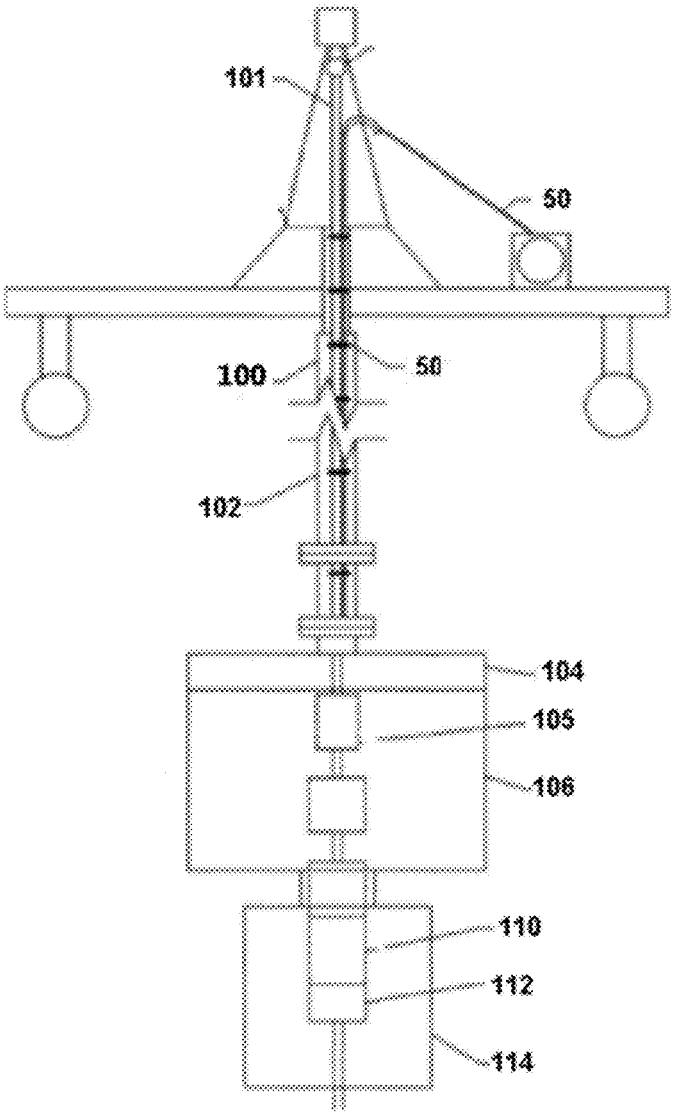
FIG. 11 is a schematic view of an exemplary riser tree controls adapter deployed in a working environment.

Referring generally to FIG. 1, riser tree controls adapter 1 generally comprises outer riser tree controls adapter 10 and inner riser tree controls adapter 60. FIG. 11 illustrates a general subsea installation including marine riser 100, tubular 101, marine riser joints 102, lower marine riser package 104, subsea test tree 105, blowout preventer ("BOP") 106, tubing hanger running tool 110, tubing hanger 112, and subsea tree 114.

Figure 2:
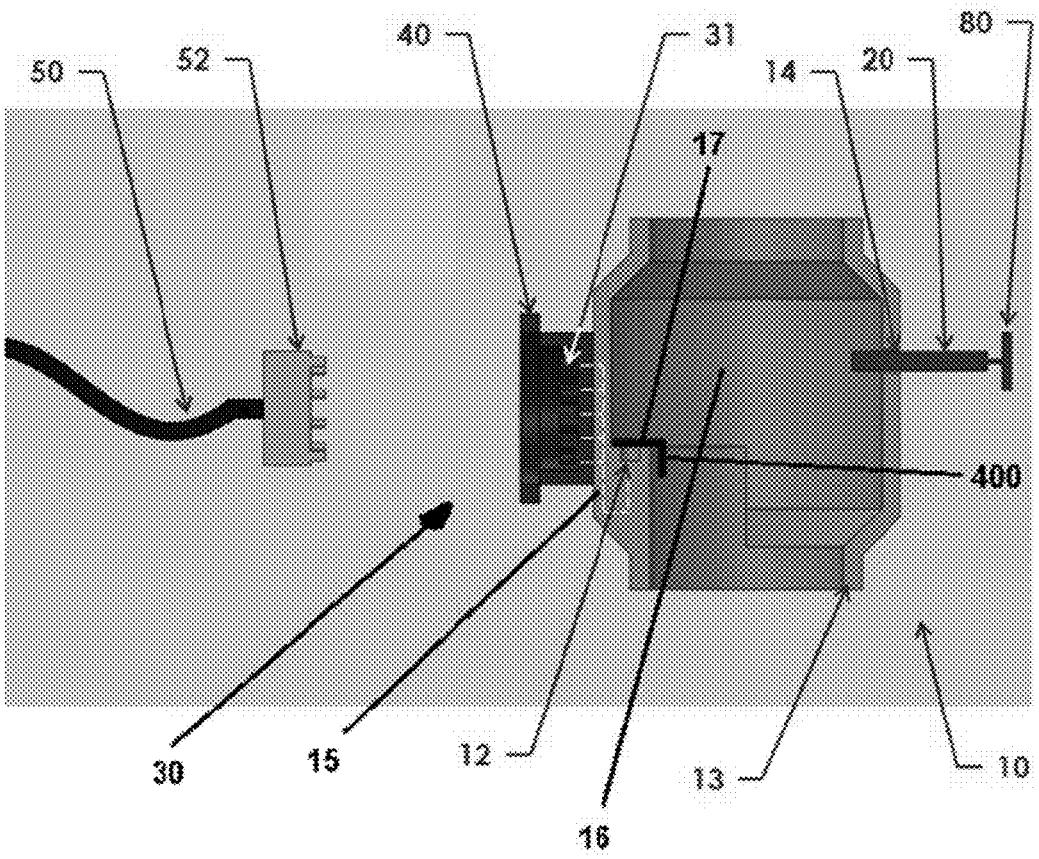
FIG. 2 is a plan view in partial perspective of an exemplary outer riser tree controls adapter.

Referring additionally to FIG. 2, outer riser tree controls adapter 10 typically comprises outer riser tree controls adapter housing 13, which is typically substantially tubular and which defines inner outer riser tree controls adapter housing annulus 16; orientation port 14 extending from an outer surface of outer riser tree controls adapter housing 13 into inner outer riser tree controls adapter housing annulus 16; orientation pin 20 configured to be slidingly received into orientation port 14 and to extend a predetermined length into inner outer riser tree controls adapter housing annulus 16; one or more inner connection interfaces 12 disposed at predetermined locations within inner outer riser tree controls adapter housing annulus 16, each typically having a predetermined portion accessible from inner outer riser tree controls adapter housing annulus 16; and control umbilical junction plate 30 attached to the outer surface of substantially tubular outer riser tree controls adapter housing 13, typically opposite orientation port 14 but at a location that does not need to be opposite orientation port 14.

Orientation pin 20 may further comprise mechanical drive 80, e.g. a torque tool, attached to a distal end of orientation pin 20, where mechanical drive 80 is adapted to be maneuvered by a remotely operated vehicle ("ROV") when orientation pin 20 is inserted into or retrieved out from orientation port 14. Generally, mechanical drive 80 is not activated until equipment such as subsea test tree 105 (FIG. 1) has passed through outer riser tree controls adapter housing 13. Further, mechanical drive 80 typically inserts orientation pin 20 into outer riser tree controls adapter housing 13 to help properly align inner riser tree controls adapter 60. By way of example and not limitation, when activated orientation pin 20 can catch or otherwise engage inner riser tree controls adapter 60 and cause inner riser tree controls adapter 60 to rotate about tubular 101 (FIG. 1).

Control umbilical junction plate 30 typically further comprises junction plate housing 40, configured to removably receive controls umbilical 50, and junction plate control connection receiver 31, adapted to receive one or more controls umbilical connections 52 and provide a set of control signal pathways 15 between junction plate control connection receiver 31 and a corresponding set of inner connection interfaces 12.

Inner outer riser tree controls adapter housing annulus 16 is typically further configured to accept a piece of equipment therethrough, such as subsea test tree 105 (FIG. 1), tubing hanger running tool 110 (FIG. 11), or the like. Conduit 74 (FIG. 4) is in communication with the piece of equipment.

In embodiments, outer riser tree controls adapter 10 further comprises shelf 17 disposed at a predetermined position within inner outer riser tree controls adapter housing annulus 16, where shelf 17 is configured to accept inner connection interfaces 12 therethrough.

Figure 3:
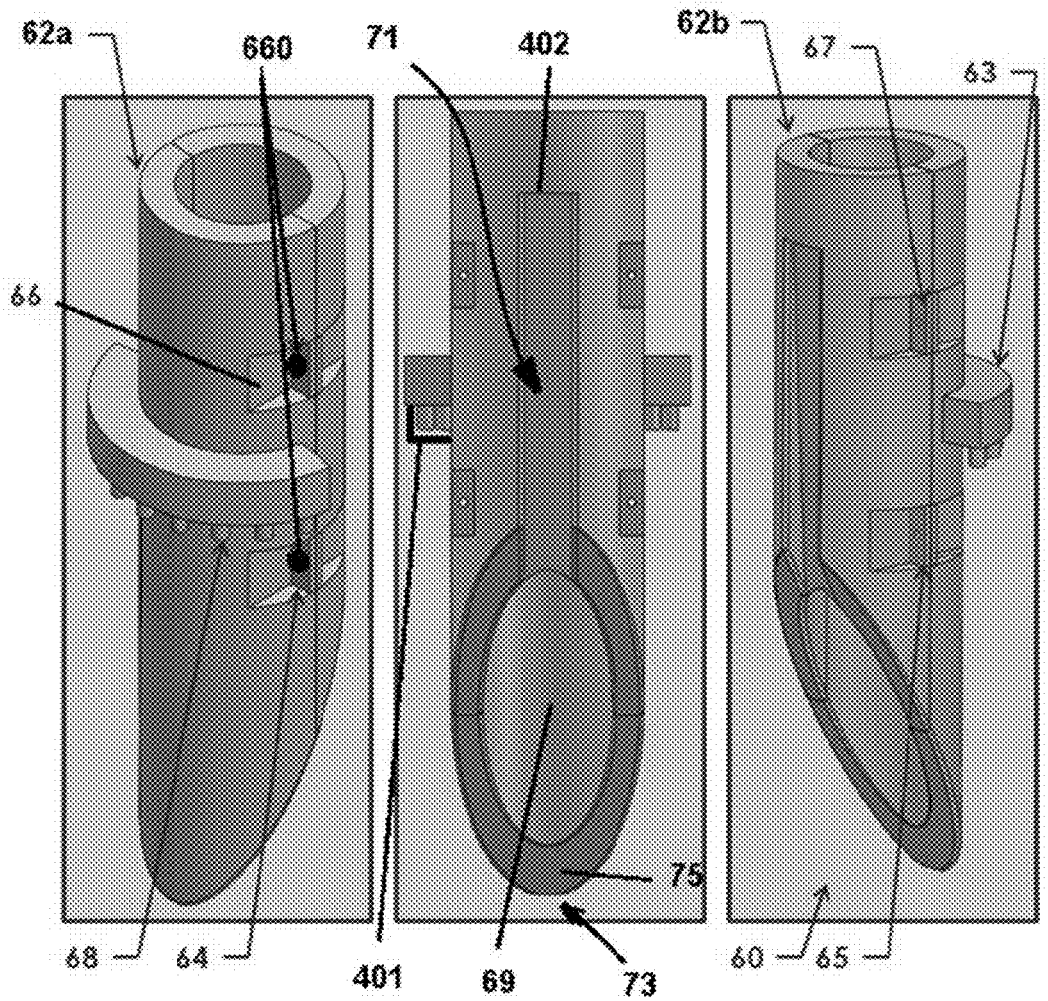
FIG. 3 are various views in partial perspective of an exemplary inner riser tree controls adapter.
Figure 4:
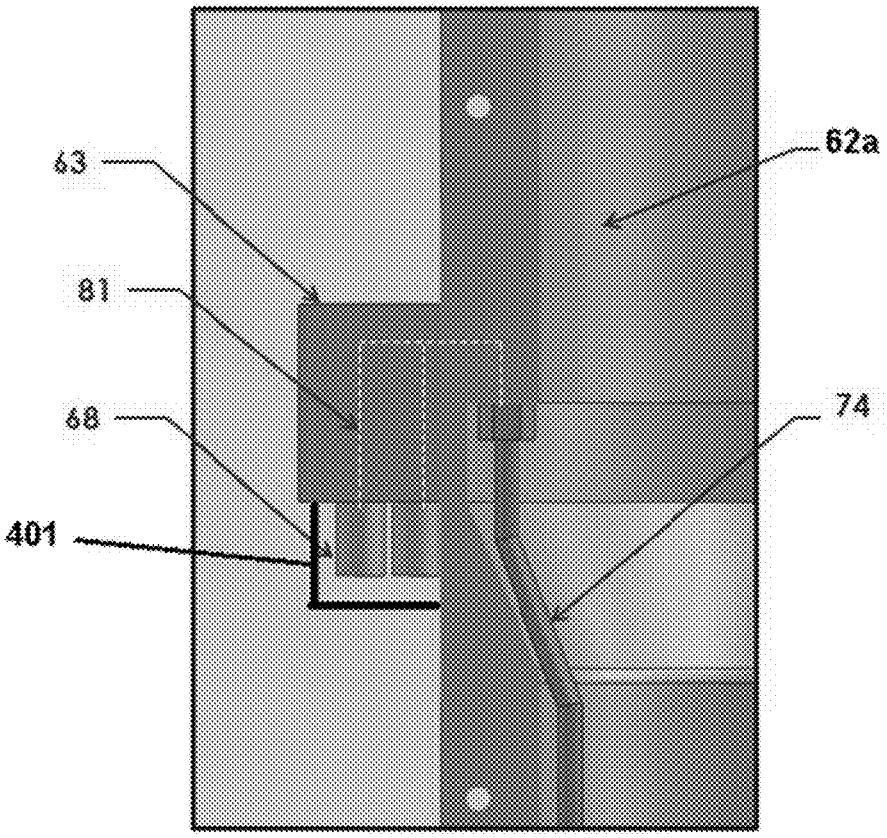
FIG. 4 is a cutaway view in partial perspective of an exemplary inner riser tree controls adapter.
Figure 5:
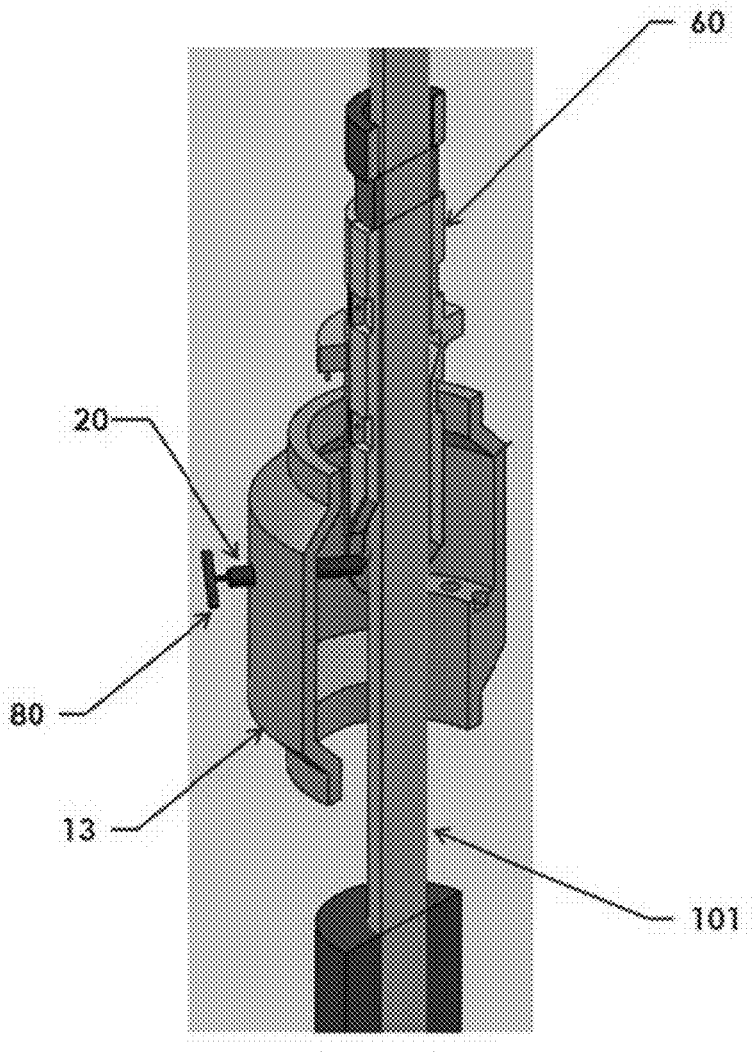
FIG. 5 is a cutaway view in partial perspective of an exemplary inner riser tree controls adapter being received into an exemplary outer riser tree controls adapter.
Figure 6:
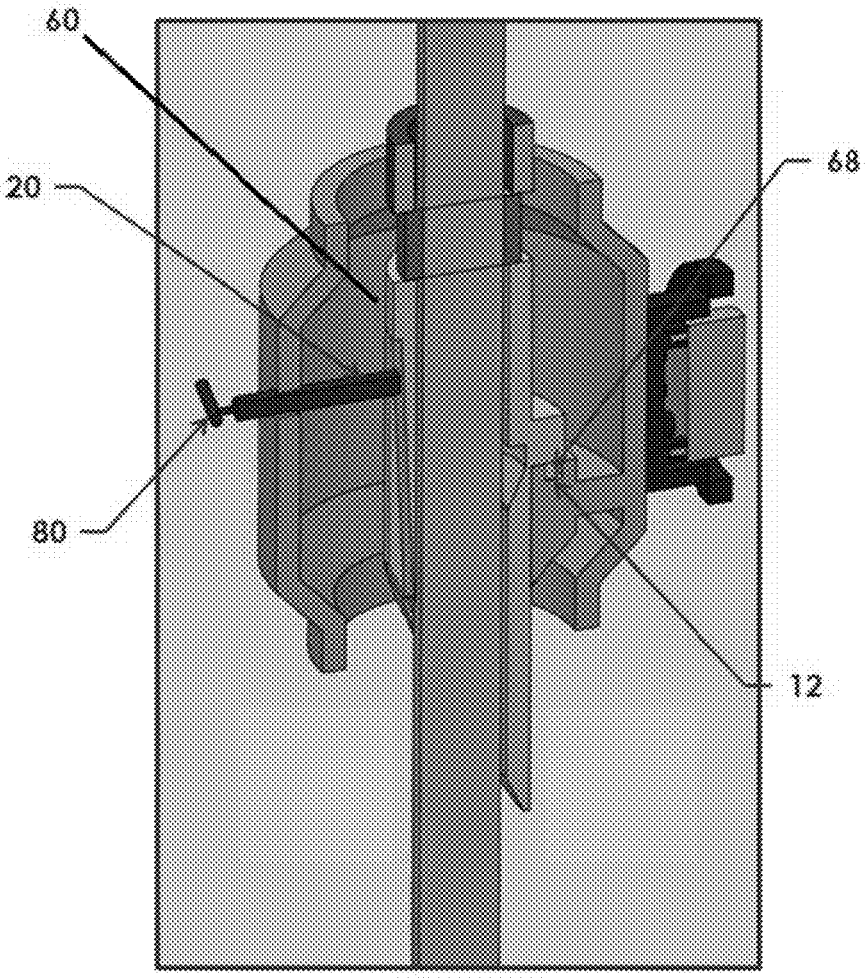
FIG. 6 is a cutaway view in partial perspective of an exemplary inner riser tree controls adapter received into and mated with an exemplary outer riser tree controls adapter.
Figure 7:
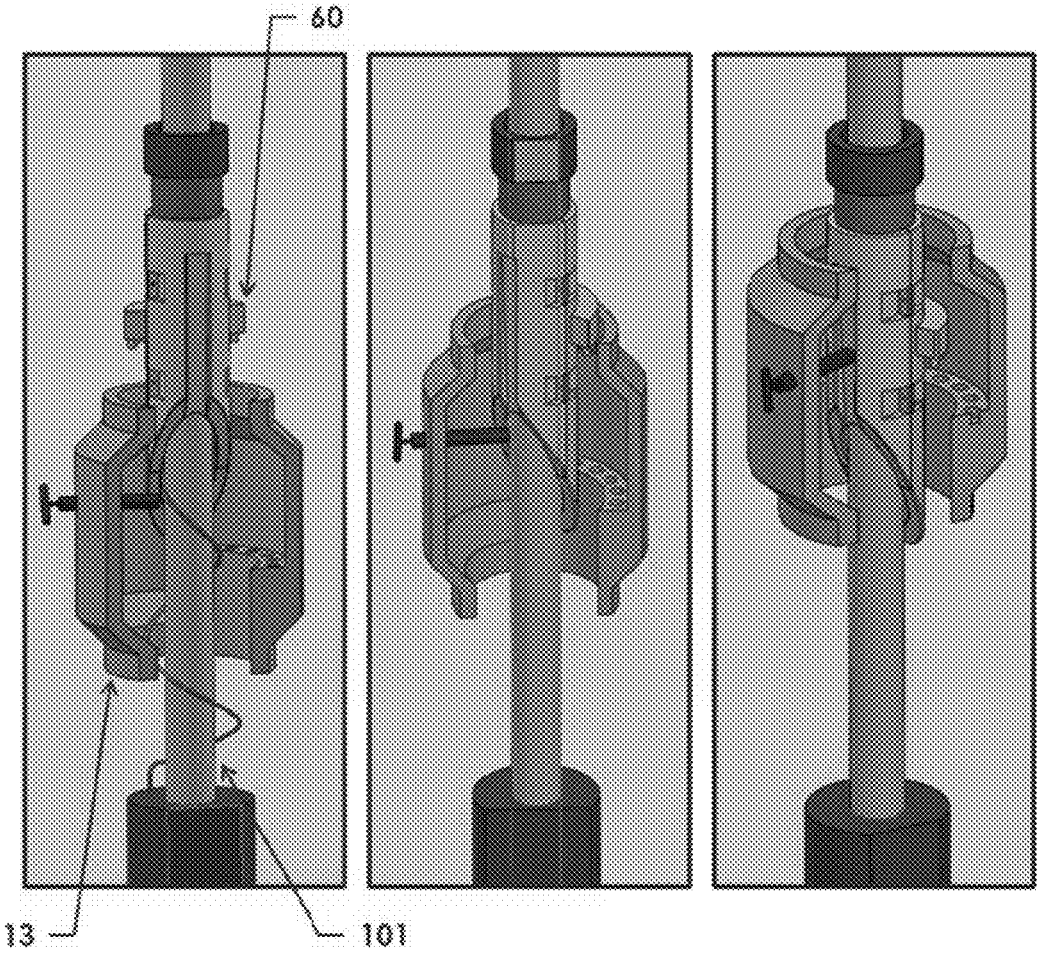
FIG. 7 is a cutaway view in partial perspective of an exemplary inner riser tree controls adapter being received into an exemplary outer riser tree controls adapter.

Referring additionally to FIGS. 3 and 4, inner riser tree controls adapter 60 typically comprises substantially tubular inner riser tree controls adapter housing 62 which, as illustrated in FIG. 3, may comprise a plurality of inner riser tree controls adapter housing portions such as 62*a*,62*b*. Substantially tubular inner riser tree controls adapter housing 62 is configured to be received into inner outer riser tree controls adapter housing annulus 16 and defines substantially tubular inner riser tree controls adapter inner annulus 69 configured to receive equipment such as tubular 101 (FIG. 1) therethrough.

Inner riser tree controls adapter 60 further comprises orientation pin guide 71 disposed about an outer surface of the substantially tubular inner riser tree controls adapter housing 62 and configured to slidingly receive orientation pin 20 (FIG. 2). Substantially tubular inner riser tree controls adapter housing 62 typically further comprises initial engagement section 73 comprising tapered insertion end 75 which is tapered at an angle, and configured to slidingly receive orientation pin 20 and guide orientation pin 20 into the orientation pin guide 71.

One or more adapter control connectors 68 are also present and configured to operatively mate with a corresponding set of inner connection interfaces 12 (FIG. 2) and provide communication between controls umbilical connections 52 (FIG. 1) and one or more conduits 74 (FIG. 4).

If shelf 17 (FIG. 2) is present, substantially tubular inner riser tree controls adapter housing 62 may further comprise shelf 63 configured to selectively engage shelf 17 and support adapter control connector 68.

As noted above, inner riser tree controls adapter 60 may comprise a plurality of inner riser tree controls adapter housings, e.g. housings 62*a*,62*b*, which are configured to cooperatively and securely engage each other and clamp to tubular 101 (FIG. 1), e.g. a drill pipe, at a predetermined location about tubular 101. In certain embodiments, the plurality of inner riser tree controls adapter housings 62*a*, 62*b* are configured to be bolted together such as with bolts 660.

In most configurations, orientation pin 20 (FIG. 2) is configured to slidingly engage inner riser tree controls adapter 60 at and/or within orientation pin guide 71, and typically configured to force inner riser tree controls adapter 60 to rotate about tubular 101 (FIG. 1) and properly align adapter control connector 68 and inner connection interface 12 (FIG. 2). Inner riser tree controls adapter 60 is typically configured to be able to rotate about tubular 101 without requiring tubular 101 to rotate.

In order to better control riser tree controls adapter 1 (FIG. 1), orientation pin guide 71 may comprise orientation pin travel limiter 402 which will stop or otherwise limit travel of orientation pin 20 within orientation pin guide 71. In embodiments, orientation pin guide 71 comprises initial engagement section 73 which is wider than orientation pin travel limiter 402 and progressively narrows from initial engagement section 73 to orientation pin travel limiter 402. In most operations adapter control connectors 68 should bottom out first.

Figure 8:
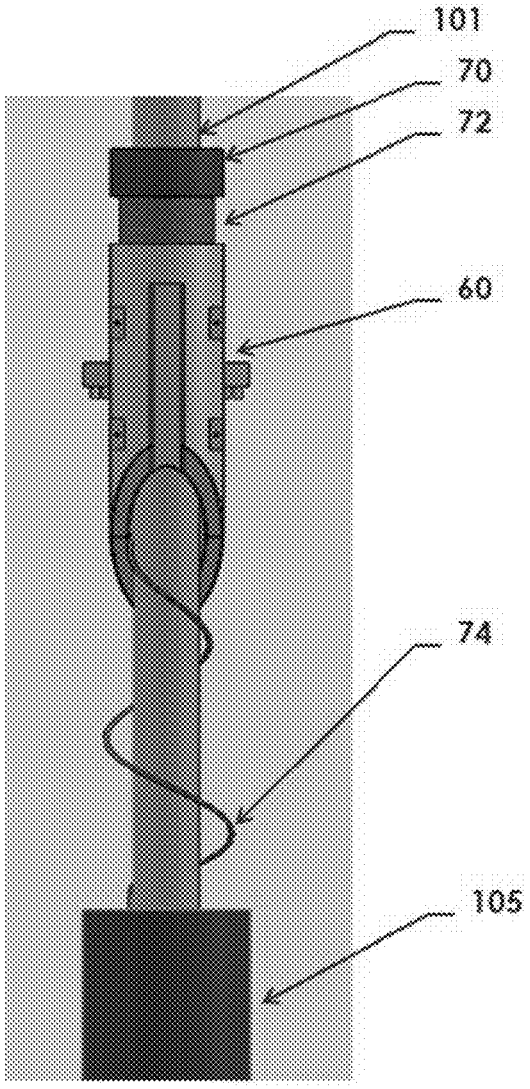
FIGS. 8-10 are views in partial perspective of an exemplary inner riser tree controls adapter positioned above an exemplary outer riser tree controls adapter and a spring disposed intermediate a clamp and the exemplary inner riser tree controls adapter.
Figure 9:
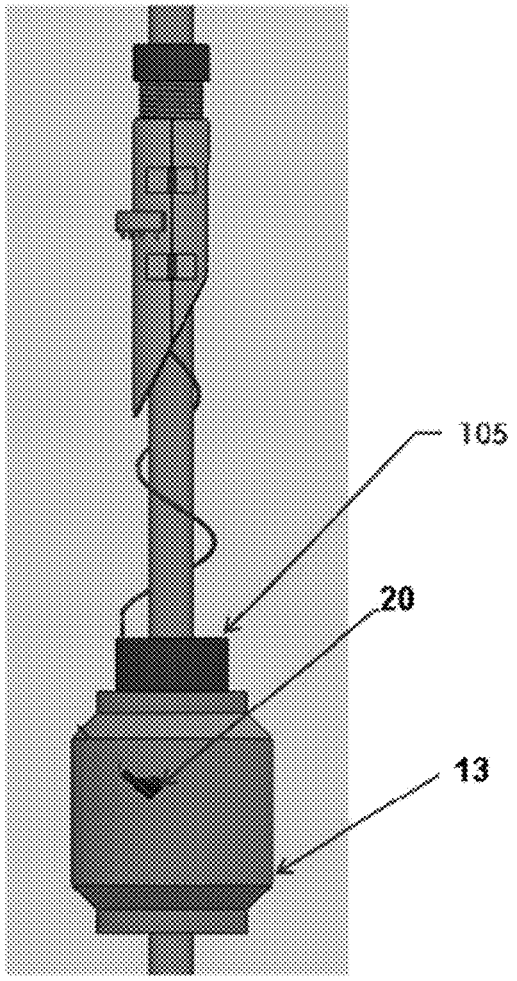
Figure 10:
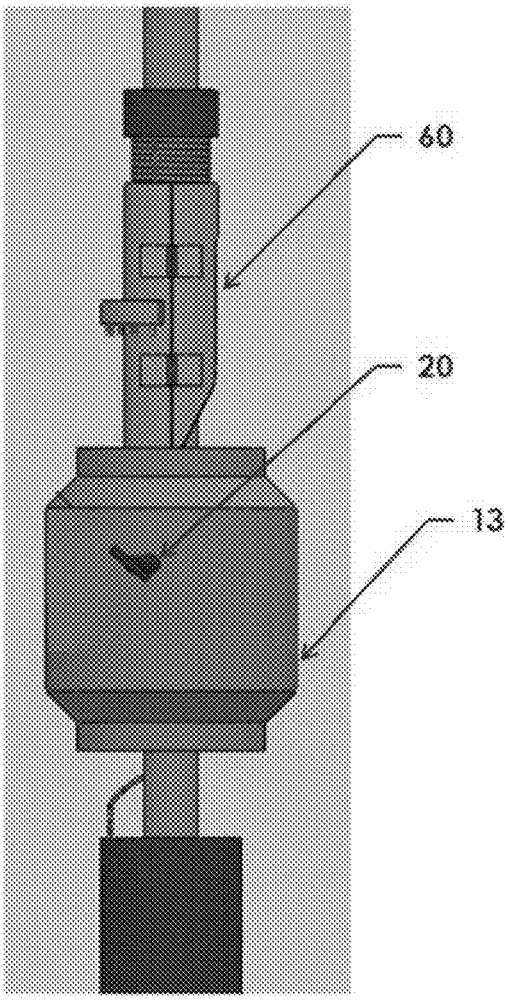

Referring now to FIGS. 5-10, clamp 70 (FIG. 8) may be present and disposed about a predetermined portion of tubular 101 (FIG. 8). Additionally, spring 72 (FIG. 8) may disposed intermediate clamp 70 and inner riser tree controls adapter 60 at a predetermined location. Spring 72, if present, is typically configured to allow for a predetermined amount of vertical movement of inner riser tree controls adapter 60 with respect to a longitudinal axis of tubular 101, by way of example and not limitation allowing for between around one 1 foot to around ten 10 feet of vertical movement.

Referring back to FIGS. 2 and 4, in certain embodiments first protective covering 400 (FIG. 2) is disposed about inner connection interface 12 and second protective covering 401 (FIG. 4) is disposed about adapter control connector 68, each protective covering 400,401 being configured to prevent damage when the inner riser tree controls adapter 60 is not in use.

In the operation of exemplary embodiments, referring generally to FIG. 1 and FIGS. 5-8, inside riser tree controls adapter 1 may be used to move connections from inside riser 102 (FIG. 1) to outside riser 102. Doing so may reduce the risk of a controls umbilical such as controls umbilical 50 being damaged, reduce rig down time, and increase rig efficiency by increasing the speed of deployment and retrieval.

Inner riser tree controls adapter 1 may be provided by deploying outer riser tree controls adapter 10 about a first predetermined portion of an outer surface of tubular 101. Outer riser tree controls adapter 10 is as described above.

In certain embodiments where housing 62 comprises a plurality of housing portions such as 62*a*,62*b* (FIG. 3), deploying inner riser tree controls adapter 60 about tubular 101 comprises positioning and placing each such portion about tubular 101 and then securing each such portion to each other portion, e.g. by clamping and/or bolting the portions together using one or more bolts 660. One or more bolt plates 64,65,66,67 may be provided to accommodate bolting or otherwise securing housing portions as 62*a*,62*b* together.

Inner riser tree controls adapter 60 is deployed about a second predetermined portion of tubular 101, where inner riser tree controls adapter 60 is as described herein, and maneuvered to where orientation pin guide 71 is proximate to orientation pin 20. Orientation pin 20 is then engaged via orientation port 14 into orientation pin guide 71 and inner riser tree controls adapter 60 mated into inner outer riser tree controls adapter housing annulus 16 until adapter control connector 68 operatively mates with inner connection interface 12.

In certain embodiments, operatively mating adapter control connector 68 with inner connection interface 12 further comprises providing inner connection interface 12 with first protective covering 400 (FIG. 2) and adapter control connector 68 with second protective covering 401 (FIG. 4) used to help prevent damage when inner connection interface 12 and/or not adapter control connector 68 are not in use. These protective coverings 400,401 may be removed once inner riser tree controls adapter 60 is properly aligned and, thereafter, adapter control connector 68 is interfaced with inner connection interface 12.

Typically, orientation pin 20 is allowed to guide travel of inner riser tree controls adapter 60 into inner outer riser tree controls adapter housing annulus 16 during the mating of inner riser tree controls adapter 60 into inner outer riser tree controls adapter housing annulus 16. If orientation pin travel limiter 402 is present, travel of inner riser tree controls adapter 60 into inner outer riser tree controls adapter housing annulus 16 to where adapter control connector 68 operatively mates with inner connection interface 12 further comprises using orientation pin travel limiter 402 to limit the procession of inner riser tree controls adapter 60 into inner outer riser tree controls adapter housing annulus 16 by if travel beyond orientation pin travel limiter 402 is attempted. However, as noted above, in most operations adapter control connectors 68 should bottom out first.

In these and other embodiments, travel of inner riser tree controls adapter 60 into inner outer riser tree controls adapter housing annulus 16 to where adapter control connector 68 operatively mates with inner connection interface 12 may comprise, or may additionally comprise, limiting travel of inner riser tree controls adapter 60 into inner outer riser tree controls adapter housing annulus 16 by providing outer riser tree controls adapter 10 with shelf 17 disposed at a predetermined position within inner outer riser tree controls adapter housing annulus 16, where shelf 17 is configured to accept inner connection interface 12 therethrough, and providing inner riser tree controls adapter housing 62 with shelf 63 configured to selectively engage shelf 17. Travel of inner riser tree controls adapter 60 into inner outer riser tree controls adapter housing annulus 16 is then substantially stopped when shelf 63 engages shelf 17. If inner riser tree controls adapter housing 62 comprises a plurality of housing portions, e.g. 62*a*,62*b*, one or more of the housing portions may comprise one or more shelves 63.

In various embodiments, inner riser tree controls adapter housing 62, whether a single housing 62 or multiple housing pieces such as 62*a*,62*b*, comprises initial engagement section 73 which is tapered at an angle to tapered insertion end 75. Tapered insertion end 75 is configured to slidingly receive orientation pin 20 and guide orientation pin 20 into orientation pin guide 71.

In embodiments with a progressively narrowing orientation pin guide 71 such as but not limited to that which is illustrated in FIG. 3, orientation pin 20 is allowed to engage with initial engagement section 73 and inner riser tree controls adapter 60 allowed to rotate about tubular 101 as inner riser tree controls adapter 60 progresses into inner outer riser tree controls adapter housing annulus 16 without requiring tubular 101 to rotate.

Travel of inner riser tree controls adapter 60 is allowed to progress into inner outer riser tree controls adapter housing annulus 16 to where adapter control connector 68 operatively mates with inner connection interface 12, as described above.

Typically, controls umbilical 50 (FIG. 1) is received into control umbilical junction plate 30, which is as described above, after adapter control connector 68 operatively mates with inner connection interface 12, but need not be, e.g. connecting controls umbilical 50 to junction plate housing 40 may occur prior to or after deployment of tubing hanger 112 (FIG. 11) and/or subsea test tree 105 (FIG. 1).

Once received into control umbilical junction plate 30, controls umbilical 50 is typically secured into control umbilical junction plate 30 and junction plate control connection receiver 31 mated with controls umbilical connection 52, providing one or more control signal pathways 15 between each junction plate control connection receiver 31 and each corresponding inner connection interface 12.

If clamp 70 is used, it is typically disposed about a predetermined portion of tubular 101 above inner riser tree controls adapter 60, e.g. towards the sea surface. Typically, spring 72 is also used if clamp 70 is used, where spring 72 is disposed intermediate clamp 70 and inner riser tree controls adapter 60 at a predetermined location. As described above, spring 72 is typically configured to allow for a predetermined amount of vertical movement of inner riser tree controls adapter 60 with respect to a longitudinal axis of tubular 101, by way of example and not limitation allowing for between around one 1 foot to around ten 10 feet of vertical movement The foregoing disclosure and description of the inventions are illustrative and explanatory. Various changes in the size, shape, and materials, as well as in the details of the illustrative construction and/or an illustrative method may be made without departing from the spirit of the invention.

We claim:

1. A riser tree controls adapter, comprising:

a. an outer riser tree controls adapter, comprising:

i. an outer riser tree controls adapter housing defining an inner outer riser tree controls adapter housing annulus;

ii. an orientation port extending from an outer surface of the outer riser tree controls adapter housing into the inner outer riser tree controls adapter housing annulus;

iii. an orientation pin configured to be slidingly received into the orientation port and extend a predetermined length into the inner outer riser tree controls adapter housing annulus;

iv. an inner connection interface disposed at a predetermined location within the inner outer riser tree controls adapter housing annulus and having a predetermined portion accessible from the inner outer riser tree controls adapter housing annulus; and v. a control umbilical junction plate attached to the outer surface of the outer riser tree controls adapter housing, the control umbilical junction plate comprising:

1. a junction plate housing configured to removably receive a controls umbilical; and 2. a junction plate control connection receiver adapted to receive a controls umbilical connection and provide a control signal pathway between the junction plate control connection receiver and the inner connection interface; and b. an inner riser tree controls adapter, comprising:

i. an inner riser tree controls adapter housing configured to be received into the inner outer riser tree controls adapter housing annulus, the inner riser tree controls adapter housing defining an inner riser tree controls adapter inner annulus configured to receive a tubular therethrough;

ii. an orientation pin guide disposed about an outer surface of the inner riser tree controls adapter housing and configured to slidingly receive the orientation pin; and iii. an adapter control connector configured to operatively mate with the inner connection interface and provide communication between the controls umbilical connection and a conduit.

2. The riser tree control system of claim 1, further comprising:

a. a clamp disposed about a predetermined portion of the tubular; and b. a spring disposed intermediate the clamp and the inner riser tree controls adapter at a predetermined location, the spring configured to allow for a predetermined amount of vertical movement of the inner riser tree controls adapter with respect to a longitudinal axis of the tubular.

3. The riser tree control system of claim 2, wherein the spring is located in-between the clamp and the inner riser tree controls adapter to allow for between around one foot to around ten feet of vertical movement.

4. The riser tree control system of claim 1, wherein:

a. the outer riser tree controls adapter further comprises an outer riser tree controls adapter shelf disposed at a predetermined portion within the inner outer riser tree controls adapter housing annulus, the outer riser tree controls adapter shelf configured to accept the inner connection interface therethrough; and b. the inner riser tree controls adapter housing comprises a substantially tubular inner riser tree controls adapter housing which further comprises an inner riser tree controls adapter housing shelf configured to selectively engage the outer riser tree controls adapter shelf, the inner riser tree controls adapter housing shelf configured to support the adapter control connector.

5. The riser tree controls adapter system of claim 1, further comprising a first protective covering disposed about the inner connection interface and a second protective covering disposed about the adapter control connector, each protective covering configured to prevent damage when the inner riser tree controls adapter is not in use.

6. The riser tree controls adapter of claim 1, wherein:

c. the inner outer riser tree controls adapter housing annulus is further configured to accept a subsea test tree or a tubing hanger running tool therethrough; and d. the conduit is in communication with the subsea test tree or the tubing hanger running tool.

7. The riser tree controls adapter of claim 1, wherein the orientation pin further comprises a mechanical drive attached to a distal end, the mechanical drive adapted to be maneuvered by a remotely operated vehicle when inserting the orientation pin into or retrieving the orientation pin out from the orientation port.

8. The riser tree controls adapter of claim 1, wherein the inner riser tree controls adapter further comprises a plurality of inner riser tree controls adapter housings configured to cooperatively and securely engage each other and clamp to the tubular at a predetermined location about the tubular.

9. The riser tree control system of claim 8, wherein the plurality of inner riser tree controls adapter housings are configured to be bolted together.

10. The riser tree controls adapter of claim 1, wherein the orientation pin is configured to slidingly engage the inner riser tree controls adapter at the orientation pin guide, force the inner riser tree controls adapter to rotate about the tubular, and properly align the adapter control connector and the inner connection interface.

11. The riser tree control system of claim 10, wherein the inner riser tree controls adapter is configured to be able to rotate about the tubular without requiring the tubular to rotate.

12. The riser tree control system of claim 1, wherein the orientation pin guide comprises an orientation pin travel limiter.

13. The riser tree control system of claim 12, wherein the tubular inner riser tree controls adapter housing further comprises an initial engagement section comprising a tapered insertion end which is tapered at an angle starting at one side of the initial engagement section and angling to an opposite side of the initial engagement section, the tapered insertion end configured to slidingly receive the orientation pin and guide the orientation pin into the orientation pin guide.

14. A method of providing a riser tree controls adapter, comprising:

a. deploying an outer riser tree controls adapter about a first predetermined portion of an outer surface of a tubular, the outer riser tree controls adapter comprising:
   ii. a substantially tubular outer riser tree controls adapter housing defining an inner outer riser tree controls adapter housing annulus;
   iii. an orientation port extending from an outer surface of the substantially tubular outer riser tree controls adapter housing into the inner outer riser tree controls adapter housing annulus;
   iv. an orientation pin configured to be slidingly received into the orientation port and extend a predetermined length into the inner outer riser tree controls adapter housing annulus;
   v. an inner connection interface disposed at a predetermined location within the inner outer riser tree controls adapter housing annulus and having a predetermined portion accessible from the inner outer riser tree controls adapter housing annulus; and
   vi. a control umbilical junction plate attached to the outer surface of the substantially tubular outer riser tree controls adapter housing, the control umbilical junction plate comprising:
      1. a junction plate housing configured to removably receive a controls umbilical; and
      2. a junction plate control connection receiver adapted to receive a controls umbilical connection and provide a control signal pathway between the junction plate control connection receiver and the inner connection interface;
b. deploying an inner riser tree controls adapter about a second predetermined portion of the tubular, the inner riser tree controls adapter comprising:
   i. a substantially tubular inner riser tree controls adapter housing configured to be received into the inner outer riser tree controls adapter housing annulus, the substantially tubular inner riser tree controls adapter housing defining a substantially tubular inner riser tree controls adapter inner annulus configured to receive a second tubular therethrough;
   ii. an orientation pin guide disposed about an outer surface of the substantially tubular inner riser tree controls adapter housing and configured to slidingly receive the orientation pin; and
   iii. an adapter control connector configured to operatively mate with the inner connection interface and provide communication between the controls umbilical connection and a conduit;
c. maneuvering the inner riser tree controls adapter to where the orientation pin guide is proximate to the orientation pin;
d. engaging the orientation pin through the orientation port into the orientation pin guide;
e. mating the inner riser tree controls adapter into the inner outer riser tree controls adapter housing annulus;
f. allowing the orientation pin to guide travel of the inner riser tree controls adapter into the inner outer riser tree controls adapter housing annulus during the mating of the inner riser tree controls adapter into the inner outer riser tree controls adapter housing annulus; and
g. allowing the travel of the inner riser tree controls adapter to progress into the inner outer riser tree controls adapter housing annulus to where the adapter control connector operatively mates with the inner connection interface.

15. The method of providing a riser tree controls adapter of claim 14, wherein allowing the travel of the inner riser tree controls adapter into the inner outer riser tree controls adapter housing annulus to where the adapter control connector operatively mates with the inner connection interface further comprises:

a. providing the orientation pin guide with an orientation pin travel limiter; and
b. allowing the inner riser tree controls adapter to proceed into the inner outer riser tree controls adapter housing annulus until the adapter control connector operatively mates with the inner connection interface.

16. The method of providing a riser tree controls adapter of claim 15, further comprising:

a. providing the substantially tubular inner riser tree controls adapter housing with an initial engagement section comprising a tapered insertion end which is tapered at an angle starting at one side of the initial engagement section and angling to an opposite side of the initial engagement section, the tapered insertion end configured to slidingly receive the orientation pin and guide the orientation pin into the orientation pin guide;
a. allowing the orientation pin to engage with the initial engagement section; and
b. allowing the inner riser tree controls adapter to rotate about the tubular as the inner riser tree controls adapter progresses into the inner outer riser tree controls adapter housing annulus without requiring the tubular to rotate.

17. The method of providing a riser tree controls adapter of claim 14, wherein allowing the travel of the inner riser tree controls adapter into the inner outer riser tree controls adapter housing annulus to where the adapter control connector operatively mates with the inner connection interface further comprises limiting travel of the inner riser tree controls adapter into the inner outer riser tree controls adapter housing annulus by:

a. providing the outer riser tree controls adapter with an outer riser tree controls adapter shelf disposed at a predetermined portion within the inner outer riser tree controls adapter housing annulus, the outer riser tree controls adapter shelf configured to accept the inner connection interface therethrough;

b. providing the substantially tubular inner riser tree controls adapter housing with an inner riser tree controls adapter shelf configured to selectively engage the outer riser tree controls adapter shelf; and c. substantially stopping the travel of the inner riser tree controls adapter into the inner outer riser tree controls adapter housing annulus when the inner riser tree controls adapter shelf engages the outer riser tree controls adapter shelf.

18. The method of providing a riser tree controls adapter of claim 14, wherein deploying the inner riser tree controls adapter about the second predetermined portion of the tubular further comprises:

a. placing a first portion of the inner riser tree controls adapter about the tubular;

b. placing a second portion of the inner riser tree controls adapter about the tubular proximate the first portion of the inner riser tree controls adapter; and c. securing the first portion of the inner riser tree controls adapter to the second portion of the inner riser tree controls adapter.

19. The method of providing a riser tree controls adapter of claim 14, wherein operatively mating the adapter control connector with the inner connection interface further comprises:

a. providing the inner connection interface with a first protective covering;

b. providing the adapter control connector with a second protective covering;

c. removing the protective coverings once the inner riser tree controls adapter is properly aligned; and d. once the protective coverings have been removed, interfacing the adapter control connector with the inner connection interface.

20. The method of providing a riser tree controls adapter of claim 14, further comprising:

a. receiving a controls umbilical into the control umbilical junction plate, the controls umbilical comprising a controls umbilical connection;

b. connecting the controls umbilical to the control umbilical junction plate; and c. mating the junction plate control connection receiver with the controls umbilical connection, providing a control signal pathway between the junction plate control connection receiver and the inner connection interface.

* * * * *